US006491111B1

(12) United States Patent
Livingston et al.

(10) Patent No.: US 6,491,111 B1
(45) Date of Patent: Dec. 10, 2002

(54) ROTARY IMPACT TOOL HAVING A TWIN HAMMER MECHANISM

(75) Inventors: Patrick S. Livingston, Easton, PA (US); Kevin R. Morey, Bethlehem, PA (US)

(73) Assignee: Ingersoll-Rand Company, Woodcliff Lake, NJ (US)

( * ) Notice: Subject to any disclaimer, the term of this patent is extended or adjusted under 35 U.S.C. 154(b) by 73 days.

(21) Appl. No.: 09/617,333

(22) Filed: Jul. 17, 2000

(51) Int. Cl.[7] ..... B25D 15/00

(52) U.S. Cl. ..... 173/93.5; 173/93; 173/93.6

(58) Field of Search ..... 173/93, 93.5, 93.6

(56) References Cited

U.S. PATENT DOCUMENTS

| | | | | |
|---|---|---|---|---|
| 2,285,638 | A | 6/1942 | Amtsberg | 192/30.5 |
| 2,580,631 | A | 1/1952 | Whitledge | |
| 2,663,395 | A | 12/1953 | Schmid | |
| 2,802,556 | A | 8/1957 | Schmid | |
| 3,072,232 | A | 1/1963 | Martin et al. | |
| 3,321,043 | A | 5/1967 | Vaughn | |
| 3,389,756 | A | 6/1968 | Kawamoto | |
| 3,414,066 | A | 12/1968 | Wallace | |
| 3,428,137 | A | 2/1969 | Schaedler et al. | |
| 3,533,479 | A | 10/1970 | Mudsen | |
| 3,552,499 | A | 1/1971 | Maurer | |
| 3,605,914 | A | 9/1971 | Kramer | |
| 3,661,217 | A | 5/1972 | Maurer | 173/93.5 |
| 3,666,023 | A | 5/1972 | Sakamoto | |
| 4,002,212 | A | 1/1977 | Schoeps | |
| 4,016,940 | A | 4/1977 | Spring, Sr. | |
| 4,042,036 | A | 8/1977 | Smith et al. | |
| D248,820 | S | 8/1978 | Roth et al. | |
| D256,980 | S | 9/1980 | Adams et al. | |
| 4,287,956 | A | 9/1981 | Maurer | |
| 4,321,973 | A | 3/1982 | Maurer | |
| 4,347,902 | A | 9/1982 | Wallace et al. | |
| 4,487,272 | A | 12/1984 | Bleicher et al. | |
| 4,585,078 | A | 4/1986 | Alexandrov et al. | |

(List continued on next page.)

FOREIGN PATENT DOCUMENTS

| | | |
|---|---|---|
| GB | 2055653 A | 3/1981 |
| GB | 2059317 A | 4/1981 |
| WO | WO 99/17909 | 4/1999 |

OTHER PUBLICATIONS

Printed publication titled "Designing the Engagement Profile of Rotation–Impulse Converters," authored by V. R. Volovich, et al., published in the Russian Engineering Journal, vol. 51, No. 1, pp. 21 through 24, in 1971.

*Primary Examiner*—Scott A. Smith
*Assistant Examiner*—Nathaniel Chukwurah

(57) ABSTRACT

A rotary impact tool having a twin hammer mechanism that generally includes a housing having a hollow cage or carrier member positioned therein. A pair of hollow hammer members are pivotally positioned relative to the hollow cage or carrier member so the hollow hammer members rotate with the hollow cage or carrier member under drive from an air motor output shaft. An anvil is positioned inside the hollow hammer members and the anvil rotates relative to the hollow hammer members. The anvil preferably includes a forward anvil lug, a rearward anvil lug and an annular ring positioned intermediate the forward anvil lug, and the rearward anvil lug. To facilitate assembly of the anvil through the hollow hammer members, the annular ring could be a reduced diameter annular ring or the sides of a full diameter annular ring could be reduced or narrowed. Positive spacing of the hollow hammer members can be achieved by placing a spacer between the hollow hammer members. Alternatively, positive spacing of the hollow hammer members can be achieved by extending the hollow hammer members over the annular ring on the anvil with a step provided on the hollow hammer members to provide clearance for the annular ring on the anvil.

16 Claims, 4 Drawing Sheets

U.S. PATENT DOCUMENTS

| | | | | |
|---|---|---|---|---|
| D288,769 | S | | 3/1987 | Doman |
| D288,770 | S | | 3/1987 | Doman |
| 4,735,595 | A | | 4/1988 | Schoeps |
| D298,301 | S | | 11/1988 | Stephan |
| 4,977,966 | A | | 12/1990 | Farber et al. |
| 5,083,619 | A | | 1/1992 | Giardino et al. |
| D324,801 | S | | 3/1992 | Caskey et al. |
| D324,802 | S | | 3/1992 | Caskey et al. |
| 5,092,410 | A | | 3/1992 | Wallace et al. |
| D335,073 | S | | 4/1993 | Anthony et al. |
| 5,199,505 | A | | 4/1993 | Izumisawa |
| 5,346,022 | A | | 9/1994 | Krivec |
| 5,595,251 | A | | 1/1997 | Cook, Jr. |
| 5,622,230 | A | | 4/1997 | Giardino et al. |
| RE35,617 | E | | 9/1997 | Krivec |
| 5,738,177 | A | | 4/1998 | Schell et al. |
| 5,784,934 | A | | 7/1998 | Izumisawa |
| 5,836,403 | A | | 11/1998 | Putney et al. |
| D404,276 | S | | 1/1999 | Ghode et al. |
| 5,906,244 | A | | 5/1999 | Thompson et al. ..... 173/93.5 |
| D410,830 | S | | 6/1999 | Pusateri et al. |
| 5,908,076 | A | * | 6/1999 | Marcengill et al. ..... 173/205 |
| 5,941,319 | A | * | 8/1999 | Juan ..... 173/117 |
| 5,992,539 | A | * | 11/1999 | Lin ..... 173/169 |
| 6,003,618 | A | | 12/1999 | Wallace |
| 6,024,180 | A | | 2/2000 | Lin |
| 6,047,779 | A | | 4/2000 | Wallace |
| 6,070,674 | A | | 6/2000 | Williamson et al. |

* cited by examiner

ROTARY IMPACT TOOL HAVING A TWIN HAMMER MECHANISM

BACKGROUND AND SUMMARY OF THE INVENTION

The present invention relates generally to new and novel improvements in a rotary impact tool having a twin hammer mechanism. More particularly, the present invention relates to a rotary impact tool having a twin hammer mechanism, such as a air driven impact wrench, which is capable of delivering, in rapid succession, a series of rotary impact forces or blows. Such tools have typically been used to tighten or loosen high torque nut or bolts or similar items.

A conventional rotary impact wrench mechanism, known as a "swinging weight" mechanism, is disclosed in U.S. Pat. No. 2,285,638 to L. A. Amtsberg, issued Jun. 9, 1942, for an "Impact Clutch." While this mechanism is rather inefficient, it is one of the first to deliver rotary force in a series of impact blows. The ability to deliver a series of impact blows provides a human operator with an advantage in that the human operator can physically hold the impact wrench while delivering high torque forces in short burst or impacts. The advantage of applying short duration high torque impact blows is that a normal human being can continue to physically hold the tool while applying high torque forces. If such high torque forces were applied continuously by the tool, an opposite continuous reaction force on the tool would be too great to allow the tool to be held by a normal human being.

An improved "swinging weight" mechanism is disclosed in U.S. Pat. No. 3,661,217 to Maurer, issued May 9, 1972, for a "Rotary Impact Tool and Clutch Therefor," the disclosure of which is hereby incorporated by reference. This issued United States patent describes and shows a swinging weight impact wrench mechanism with a hammer member that is substantially free of tensional stresses during impact. This "swinging weight" mechanism has a swinging hammer pivoted on a pivot with the center of mass of the hammer being near the center of rotation of the mechanism. This enables the swinging weight mechanism to strike a more balanced blow to an anvil and, ultimately, to the output shaft to tighten or loosen bolts, for example.

However, one problem with the "swinging weight" mechanism disclosed in issued U.S. Pat. No. 3,661,217 to Maurer, issued May 9, 1972, for a "Rotary Impact Tool and Clutch Therefor" is that high loads transmitted through the hammer and the anvil lugs can cause separation of the anvil lugs from the anvil and premature failure of the rotary impact tool.

Accordingly, an object of the present invention is to provide a rotary impact tool having a twin hammer mechanism which is less susceptible to premature failure and, thus, provides enhanced durability and service life as compared to known prior art rotary impact tools.

Another object of the present invention is the provision of a rotary impact tool having a twin hammer mechanism which is capable of applying the same amount of torque to a workpiece with less air consumption as compared to known prior art rotary impact tools.

Yet another object of the present invention is the provision of a rotary impact tool having a twin hammer mechanism which is capable of applying a greater amount of torque to a workpiece while maintaining the size of the housing as compared to known prior art rotary impact tools.

These and other objects of the present invention are attained by a rotary impact tool having a twin hammer mechanism that generally includes a housing having a hollow cage or carrier member positioned therein. A pair of hollow hammer members are pivotally positioned relative to the hollow cage or carrier member so the hollow hammer members rotate with the hollow cage or carrier member under drive from an air motor output shaft. An anvil is positioned inside the hollow hammer members and the anvil rotates relative to the hollow hammer members. The anvil preferably includes a forward anvil lug, a rearward anvil lug, and an annular ring positioned intermediate the forward anvil lug and the rearward anvil lug. To facilitate assembly of the anvil through the hollow hammer members, the annular ring can be a reduced diameter annular ring or the sides of a full diameter annular ring could be reduced or narrowed. Positive spacing of the hollow hammer members can be achieved by placing a spacer between the hollow hammer members. Alternatively, positive spacing of the hollow hammer members can be achieved by extending the hollow hammer members over the annular ring on the anvil with a step provided on each of the hollow hammer members to provide clearance for the annular ring on the anvil.

Other advantages and novel features of the present invention will become apparent in the following detailed description of the invention when considered in conjunction with the accompanying drawings.

DETAILED DESCRIPTION OF THE DRAWINGS

Figure 1:
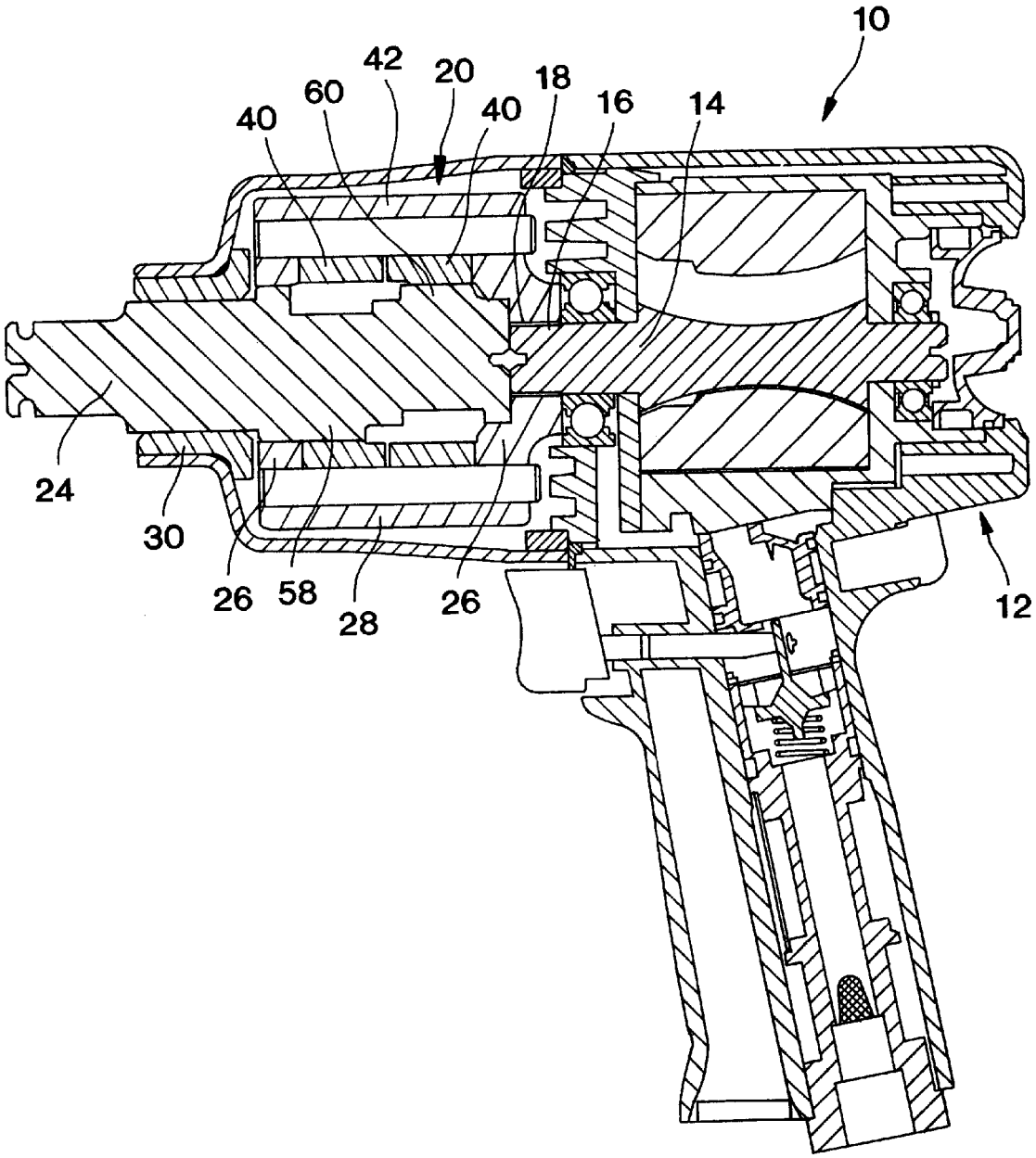
FIG. 1 is a side elevational view, shown partly in cross-section and partly in plan view, of a rotary impact tool having a twin hammer mechanism in accordance with a preferred embodiment of the present invention.

In the following detailed description of preferred embodiments of the present invention, reference is made to the accompanying drawings which, in conjunction with this detailed description, illustrate and describe preferred embodiments of a rotary impact tool having a twin hammer mechanism in accordance with the present invention. Referring first to FIG. 1, which shows a side elevational view, shown partly in cross-section and partly in plan view, of a rotary impact tool having a twin hammer mechanism in accordance with a preferred embodiment of the present invention, rotary impact tool having a twin hammer mechanism is generally identified by reference number 10. Rotary impact tool having a twin hammer mechanism 10 includes housing 12. Air motors in tools of this type are well known in the prior art and need not be described here in further detail.

Air motor output shaft 14 is coupled through meshing spines 16 and 18 to hollow cage or carrier member 20 which is journaled by sleeve bearing 22 on anvil 24. Air motor output shaft 14 is preferably coaxially aligned with anvil 24. Hollow cage or carrier member 20 is preferably coaxially mounted around anvil 24 in such a manner as allow rotation of hollow cage or carrier member 20 relative to anvil 24. Hollow cage or carrier member 20 preferably includes a pair of longitudinally spaced end plates 26 joined by a pair of diametrically spaced longitudinally extending struts 28. The forward end of anvil 24 is supported by bushing 30 mounted in the forward end of housing 12.

Figure 2:
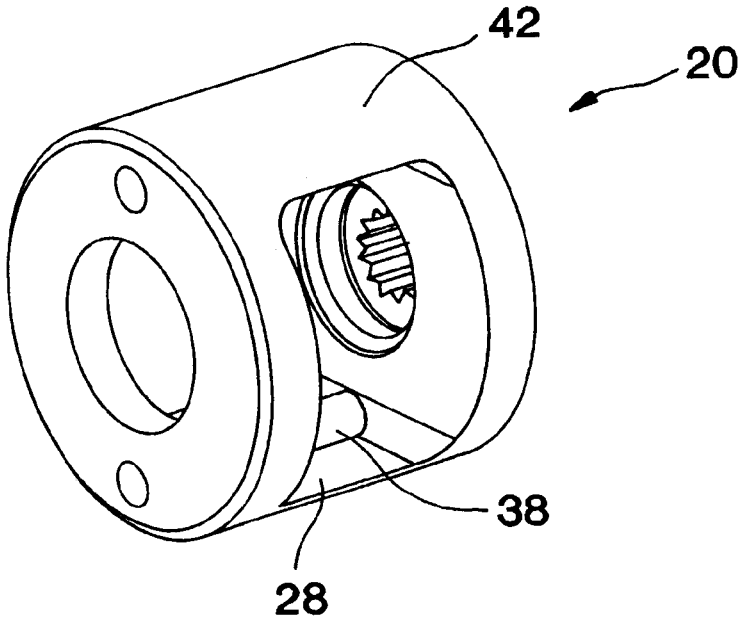
FIG. 2 is a prospective side view of a hollow cage or carrier member in accordance with a first preferred embodiment of the present invention that is capable of being used in the rotary impact tool having a twin hammer mechanism in accordance with a preferred embodiment of the present invention shown in FIG. 1.
Figure 3:
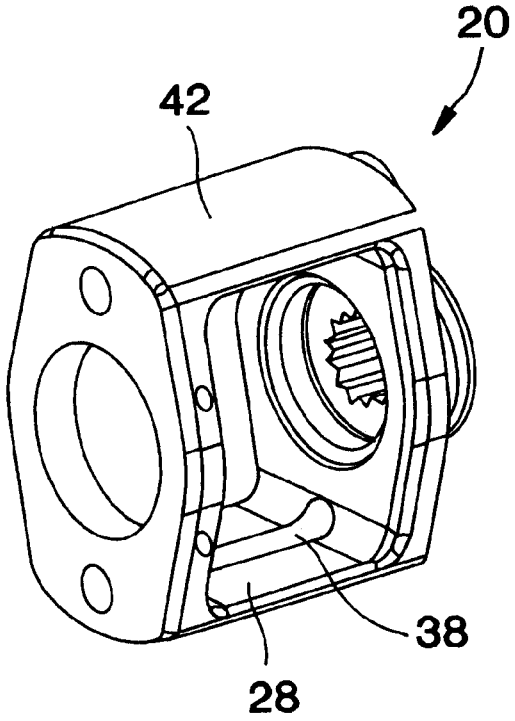
FIG. 3 is a prospective side view of a hollow cage or carrier member in accordance with a second preferred embodiment of the present invention that is capable of being used in the rotary impact tool having a twin hammer mechanism in accordance with a preferred embodiment of the present invention shown in FIG. 1.

Referring next to FIGS. 2 and 3, which show a prospective side view of a hollow cage or carrier member in accordance with a first preferred embodiment of the present invention that is capable of being used in the rotary impact tool having a twin hammer mechanism in accordance with a preferred embodiment of the present invention shown in FIG. 1 and a prospective side view of a hollow cage or carrier member in accordance with a second preferred embodiment of the present invention that is capable of being used in the rotary impact tool having a twin hammer mechanism in accordance with a preferred embodiment of the present invention shown in FIG. 1, respectively, channel 38 is located within the internal diameter of hollow cage or carrier member 20 along one of diametrically spaced longitudinally extending struts 28 and a roller pin or pivot (not shown) is positioned in channel 38 forming, in effect, a swivel connection.

FIG. 2 shows hollow cage or carrier member 20 as a full diameter hollow cage or carrier member 20. This design uses more material, and thus is heavier, than hollow cage or carrier member 20 shown in FIG. 3. The additional weight of hollow cage or carrier member 20 shown in FIG. 2 adds to the overall inertia of the rotary impact tool system. The result of higher overall inertia of the rotary impact tool system is that more force is provided with each impact of rotary impact tool having a twin hammer mechanism 10, but the air motor (not shown) speed, and thus the number of impacts per minute, is reduced. This results in substantially the same amount of torque being provided to a workpiece using hollow cage or carrier member 20 shown in FIG. 2, as compared to hollow cage or carrier member 20 shown in FIG. 3, but with fewer cycles of the air motor (not shown), and thus, less air consumption by the air motor.

Figure 4:
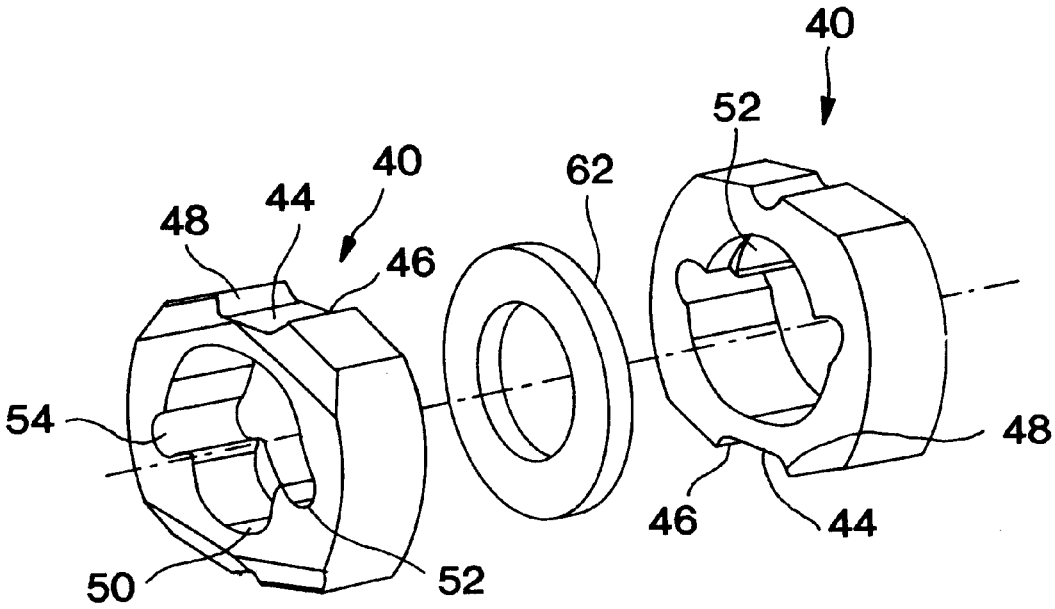
FIG. 4 is a prospective side view of hollow hammer members in accordance with a first preferred embodiment of the present invention that are capable of being used in the rotary impact tool having a twin hammer mechanism in accordance with a preferred embodiment of the present invention shown in FIG. 1.
Figure 5:
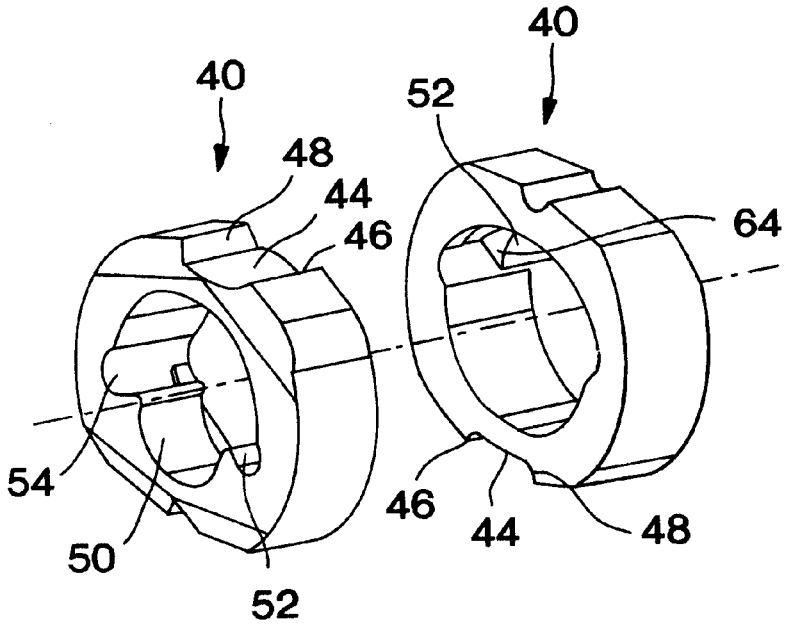
FIG. 5 is a prospective side view of hollow hammer members in accordance with a second preferred embodiment of the present invention which are capable of being used in the rotary impact tool having a twin hammer mechanism in accordance with a preferred embodiment of the present invention shown in FIG. 1.

Referring to FIGS. 4 and 5, which show a prospective side view of hollow hammer members in accordance with a first preferred embodiment of the present invention that are capable of being used in the rotary impact tool having a twin hammer mechanism in accordance with a preferred embodiment of the present invention shown in FIG. 1 and a prospective side view of hollow hammer members in accordance with a second preferred embodiment of the present invention that are capable of being used in the rotary impact tool having a twin hammer mechanism in accordance with a preferred embodiment of the present invention shown in FIG. 1, respectively, the roller pin or pivot (not shown) is preferably an elongated roller pin about which a portion of hollow hammer members 40 can partially rotate. Hollow hammer members 40 are mounted around anvil 24. Thus, hollow hammer members 40 are pivotally positioned against hollow cage or carrier member 20 about a tilt axis formed by the roller pin or pivot (not shown) so hollow hammer members 40 rotate with hollow cage or carrier member 20 under drive from air motor output shaft 14, and additionally, hollow hammer members 40 can move with an angular pivot motion relative to hollow cage or carrier member 20 about the tilt axis offset from, but parallel to, the axis of rotation of hollow cage or carrier member 20.

Hollow cage or carrier member 20 has second diametrically spaced longitudinally extending strut 42 within which is formed a second channel (not shown). A second roller pin or pivot (not shown) is positioned within the second channel (not shown). Hollow hammer members 40 have slot 44 formed on their surface which permits hollow hammer members 40 to rotate through a finite angle with respect to diametrically spaced longitudinally extending strut 28 and second diametrically spaced longitudinally extending strut 42 such that the second roller pin or pivot (not shown) will block hollow hammer members 40 from rotating past the point where edges 46 and 48 of slot 44 abut the second roller pin or pivot (not shown).

Hollow hammer members 40 have on their internal surface 50 forward impact jaw or surface 52 and reverse impact jaw or surface 54 which are movable into and out of the path of forward impact receiving surface 34 and reverse impact receiving surface 36, respectively, as rotary impact tool having a twin hammer mechanism 10 operates in the forward or reverse direction. Hollow hammer members 40 are preferably shaped in cross-section as symmetrical halves joined along a plane perpendicular to the page and passing through the center-of-gravity of hollow hammer members 40 and the center of the roller pin or pivot (not shown).

Referring next to FIGS. 6 through 9, which show a prospective side view of an anvil in accordance with a first preferred embodiment of the present invention that is capable of being used in the rotary impact tool having a twin hammer mechanism in accordance with a preferred embodiment of the present invention shown in FIG. 1, a prospective side view of an anvil in accordance with a second preferred embodiment of the present invention that is capable of being used in the rotary impact tool having a twin hammer mechanism in accordance with a preferred embodiment of the present invention shown in FIG. 1, a prospective side view of an anvil in accordance with a third preferred embodiment of the present invention that is capable of being used in the rotary impact tool having a twin hammer mechanism in accordance with a preferred embodiment of the present invention shown in FIG. 1, and a prospective side view of an anvil in accordance with a fourth preferred embodiment of the present invention that is capable of being used in the rotary impact tool having a twin hammer mechanism in accordance with a preferred embodiment of the present invention shown in FIG. 1, respectively, the rear end portion of anvil 24 includes anvil jaw 32 which extends generally radially outwardly therefrom and provides forward impact receiving surface 34 and reverse impact receiving surface 36.

Figure 6:
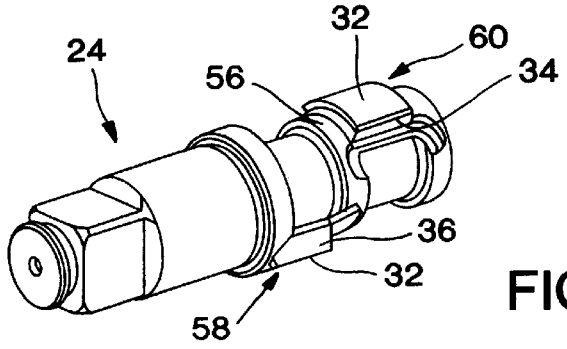
FIG. 6 is a prospective side view of an anvil in accordance with a first preferred embodiment of the present invention that is capable of being used in the rotary impact tool having a twin hammer mechanism in accordance with a preferred embodiment of the present invention shown in FIG. 1.
Figure 7:
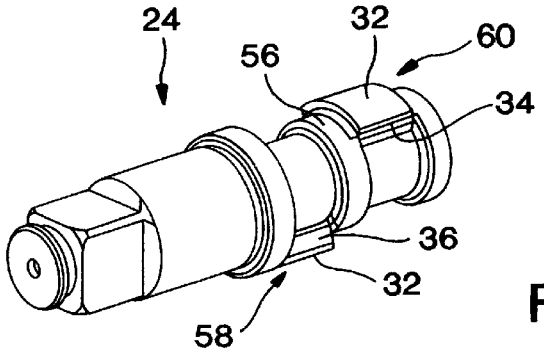
FIG. 7 is a prospective side view of an anvil in accordance with a second preferred embodiment of the present invention that is capable of being used in the rotary impact tool having a twin hammer mechanism in accordance with a preferred embodiment of the present invention shown in FIG. 1.
Figure 8:
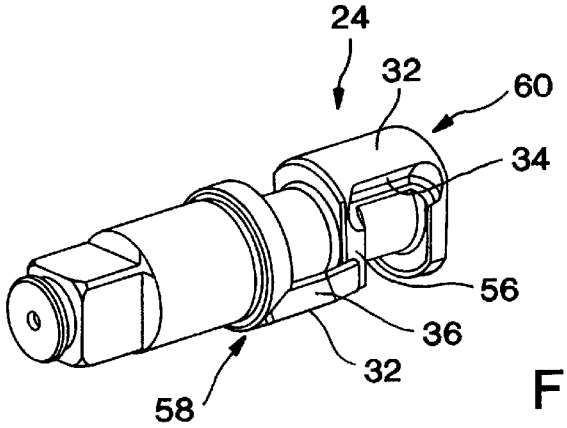
FIG. 8 is a prospective side view of an anvil in accordance with a third preferred embodiment of the present invention that is capable of being used in the rotary impact tool having a twin hammer mechanism in accordance with a preferred embodiment of the present invention shown in FIG. 1.
Figure 9:
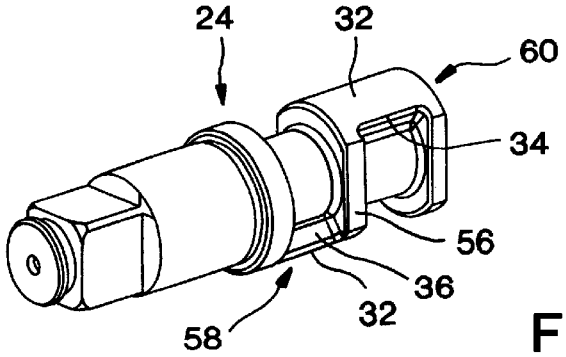
FIG. 9 is a prospective side view of an anvil in accordance with a fourth preferred embodiment of the present invention that is capable of being used in the rotary impact tool having a twin hammer mechanism in accordance with a preferred embodiment of the present invention shown in FIG. 1.

Anvil 24 preferably includes annular ring 56 that is located intermediate forward anvil lug 58 and rearward anvil lug 60. The addition of annular ring 56 on anvil 24 provides additional strength to the unsupported ends of forward anvil lug 58 and rearward anvil lug 60, which is a common starting point for failures. To allow for assembly of anvil 24 through hollow hammer members 40, annular ring 56 can be reduced in size from the diameter of forward anvil lug 58 and rearward anvil lug 60, as shown in FIGS. 6 and 7. Alternatively, annular ring 56 can be substantially the same diameter as forward anvil lug 58 and rearward anvil lug 60, but the sides of annular ring 56 can be reduced or narrowed to facilitate assembly of anvil 24 into hollow hammer members 40, as shown in FIGS. 8 and 9. The sides of annular ring 56 are preferably reduced or narrowed by providing flats on the sides of annular ring 56, as shown in FIGS. 8 and 9, although other configurations for providing a reduced or narrowed annular ring 56 could, alternatively, be used.

Positive spacing of hollow hammer members 40 can be achieved by placing spacer 62 between hollow hammer members 40 as shown in FIG. 4. Spacer 62 precludes hollow hammer members 40 from contacting annular ring 56 on anvil 24. Spacer 62 is preferably fabricated from a relatively strong, durable and light-weight material, such as a composite material, which would allow spacer 62 to be low in relative inertia. In addition, spacer 62 is preferably fabricated from a material that reduces sliding friction between hollow hammer members 40. Using spacer 62 to provide positive spacing of hollow hammer members 40 may simplify the design, and thus potentially reduce the cost, of hollow hammer members 40 since hollow hammer members 40 using spacer 62 have a substantially constant cross-sectional configuration, but the width of hollow hammer members 40 are reduced to provide space for spacer 62.

Alternatively, positive spacing of hollow hammer members 40 can be achieved by providing steps 64 on the inside face of each hollow hammer member 40 as shown in FIG. 5. This permits hollow hammer members 40 to extend over annular ring 56 on anvil 24 with steps 64 providing clearance for annular ring 56 on anvil 24. Thus, steps 64 on hollow hammer members 40 preclude hollow hammer members 40 from contacting annular ring 56 on anvil 24. Such a design would eliminate the need for a separate spacer as shown in FIG. 4. In addition, this design allows the width of hollow hammer members 40 to be maximized at their pivot points where high stresses are experienced during operation of rotary impact tool having a twin hammer mechanism 10 and also allows the weight, and thus the inertia, of hollow hammer members 40 to be maximized.

Accordingly, although the present invention has been described above in detail, the same is by way of illustration and example only and is not to be taken as a limitation on the present invention. It is apparent to those having a level of ordinary skill in the relevant art that other variations and modifications in a rotary impact tool having a twin hammer mechanism in accordance with the present invention, as described and shown herein, could be readily made using the teachings of the present invention. Accordingly, the scope and content of the present invention are to be defined only by the terms of the appended claims.

What is claimed is:

1. A rotary impact tool having a twin hammer mechanism, said rotary impact tool comprising:

a housing;

a hollow cage member or carrier member positioned within said housing;

a first hollow hammer member and a second hollow hammer member pivotally positioned within said hollow cage member or carrier member so said first hollow hammer member and said second hollow hammer member rotate with said hollow cage or carrier member under drive from an air motor output shaft; and an anvil positioned inside said first hollow hammer member and said second hollow hammer member, said anvil rotates relative to said first hollow hammer member and said second hollow hammer member, said anvil including a forward anvil lug, a rearward anvil lug and an annular ring which is positioned intermediate said forward anvil lug and said rearward anvil lug.

2. The rotary impact tool having a twin hammer mechanism in accordance with claim 1, wherein said annular ring has a diameter which is less than the diameter of said forward anvil lug and said rearward anvil lug to facilitate the assembly of said anvil within said first hollow hammer member and said second hollow hammer member.

3. The rotary impact tool having a twin hammer mechanism in accordance with claim 1, wherein said annular ring has a diameter which is substantially the same as the diameter of said forward anvil lug and said rearward anvil lug and at least a portion of said annular ring is reduced or narrowed to facilitate the assembly of said anvil within said first hollow hammer member and said second hollow hammer member.

4. The rotary impact tool having a twin hammer mechanism in accordance with claim 1, wherein said annular ring has a diameter which is substantially the same as the diameter of said forward anvil lug and said rearward anvil lug and at least a portion of each of the sides of said annular ring are reduced or narrowed to facilitate the assembly of said anvil within said first hollow hammer member and said second hollow hammer member.

5. The rotary impact tool having a twin hammer mechanism in accordance with claim 1, wherein said annular ring has a diameter which is substantially the same as the diameter of said forward anvil lug and said rearward anvil lug and a flat is provided on each of the sides of said annular ring to facilitate the assembly of said anvil within said first hollow hammer member and said second hollow hammer member.

6. The rotary impact tool having a twin hammer mechanism in accordance with claim 1, further including a spacer positioned between said first hollow hammer member and said second hollow hammer member to provide positive spacing between said first hollow hammer member and said second hollow hammer member and preclude said first hollow hammer member and said second hammer member from contacting said annular ring on said anvil.

7. The rotary impact tool having a twin hammer mechanism in accordance with claim 6, wherein said spacer is fabricated from a relatively strong, durable and light-weight material.

8. The rotary impact tool having a twin hammer mechanism in accordance with claim 6, wherein said spacer is fabricated from a material which reduces the sliding friction between said first hollow hammer member and said second hollow hammer member.

9. The rotary impact tool having a twin hammer mechanism in accordance with claim 6, wherein said spacer is fabricated from a composite material.

10. An anvil for a rotary impact tool having a twin hammer mechanism, said anvil comprising a forward anvil lug, a rearward anvil lug coaxial with said forward anvil lug and an annular ring positioned intermediate said forward anvil lug and said rearward anvil lug.

11. The anvil for a rotary impact tool having a twin hammer mechanism in accordance with claim 10, wherein said annular ring has a diameter which is less than the diameter of said forward anvil lug and said rearward anvil lug.

12. The anvil for a rotary impact tool having a twin hammer mechanism in accordance with claim 10, wherein said annular ring has a diameter which is substantially the same as the diameter of said forward anvil lug and said rearward anvil lug and at least a portion of said annular ring is reduced or narrowed.

13. The anvil for a rotary impact tool having a twin hammer mechanism in accordance with claim 10, wherein said annular ring has a diameter which is substantially the same as the diameter of said forward anvil lug and said rearward anvil lug and at least a portion of each of the sides of said annular ring are reduced or narrowed.

14. The anvil for a rotary impact tool having a twin hammer mechanism in accordance with claim 10, wherein said annular ring has a diameter which is substantially the same as the diameter of said forward anvil lug and said rearward anvil lug and a flat is provided on each of the sides of said annular ring.

15. A hollow hammer assembly for a rotary impact tool having a twin hammer mechanism, said hollow hammer assembly comprising a first hollow hammer member and a second hollow hammer member positioned coaxial with said first hollow hammer member, each of said first hollow hammer member and said second hollow hammer member include a step on an interior face thereof to provide positive spacing between said first hollow hammer member and said second hollow hammer member.

16. A rotary impact tool having a twin hammer mechanism, said rotary impact tool comprising:

a housing;

a hollow cage member or carrier member positioned within said housing;

a first hollow hammer member and a second hollow hammer member pivotally positioned within said hollow cage member or carrier member so said first hollow hammer member and said second hollow hammer member rotate with said hollow cage or carrier member under drive from an air motor output shaft; and an anvil positioned inside said first hollow hammer member and said second hollow hammer member, said anvil rotates relative to said first hollow hammer member and said second hollow hammer member, said anvil including a forward anvil lug, a rearward anvil lug and an annular ring which is positioned intermediate said forward anvil lug and said rearward anvil lug; wherein each of said first hollow hammer member and said second hollow hammer member include a step on an interior face thereof to provide positive spacing between said first hollow hammer member and said second hollow hammer member and preclude said first hollow hammer member and said second hollow hammer member from contacting said annular ring on said anvil.

* * * * *

UNITED STATES PATENT AND TRADEMARK OFFICE

CERTIFICATE OF CORRECTION

PATENT NO. : 6,491,111 B1
DATED : December 10, 2002
INVENTOR(S) : Livingston et al.

It is certified that error appears in the above-identified patent and that said Letters Patent is hereby corrected as shown below:

Column 2,
Lines 31, 37, 43, 49, 55, 60 and 65, delete “prospective” and insert -- perspective --.

Column 3,
Lines 4, 39 and 46, delete “prospective” and insert -- perspective --.
Line 29, delete “by sleeve bearing 22”.

Column 4,
Lines 6, 12, 55, 59 and 64, delete “prospective” and insert -- perspective --.

Column 5,
Line 2, delete “prospective” and insert -- perspective --.

Signed and Sealed this

Twenty-ninth Day of April, 2003

JAMES E. ROGAN
*Director of the United States Patent and Trademark Office*